US005727606A

United States Patent [19]

Weiss

[11] Patent Number: 5,727,606

[45] Date of Patent: Mar. 17, 1998

[54] CONTAINER FILLING MACHINE

[75] Inventor: Wilhelm Weiss, Lappersdorf, Germany

[73] Assignee: Krones AG Hermann Kronseder Maschinenfabrik, Nuetraubling, Germany

[21] Appl. No.: 688,707

[22] Filed: Jul. 31, 1996

[30] Foreign Application Priority Data

Aug. 17, 1995 [DE] Germany ..... 295 13 031.8

[51] Int. Cl.[6] ..... B67C 3/28

[52] U.S. Cl. ..... 141/40; 141/45; 141/57; 141/198; 141/302

[58] Field of Search ..... 141/39, 40, 6, 141/45, 57, 198, 302, 305, 308

[56] References Cited

U.S. PATENT DOCUMENTS 3,779,293 12/1973 Kaiser ..... 141/39
3,797,535 3/1974 Kaiser ..... 141/198 X
3,799,219 3/1974 Uth et al. ..... 141/39

FOREIGN PATENT DOCUMENTS 2007896 8/1971 Germany .

*Primary Examiner*—J. Casimer Jacyna
*Attorney, Agent, or Firm*—Tilton, Fallon, Lungmus & Chestnut

[57] ABSTRACT

The invention concerns a container filling machine with a supply chamber for a fluid and a compressed gas, onto which at least one filling device is attached. This device possesses a discharge opening, a fluid valve, a compressed gas valve body arranged on its valve body and a probe which determines filling height held on this compressed gas valve body. It leads out of the lower end of the compressed valve body in a gastight arrangement. Hereby is a container filling machine achieved with higher filling accuracy, greater versatility, more cleanability and low production costs.

10 Claims, 1 Drawing Sheet

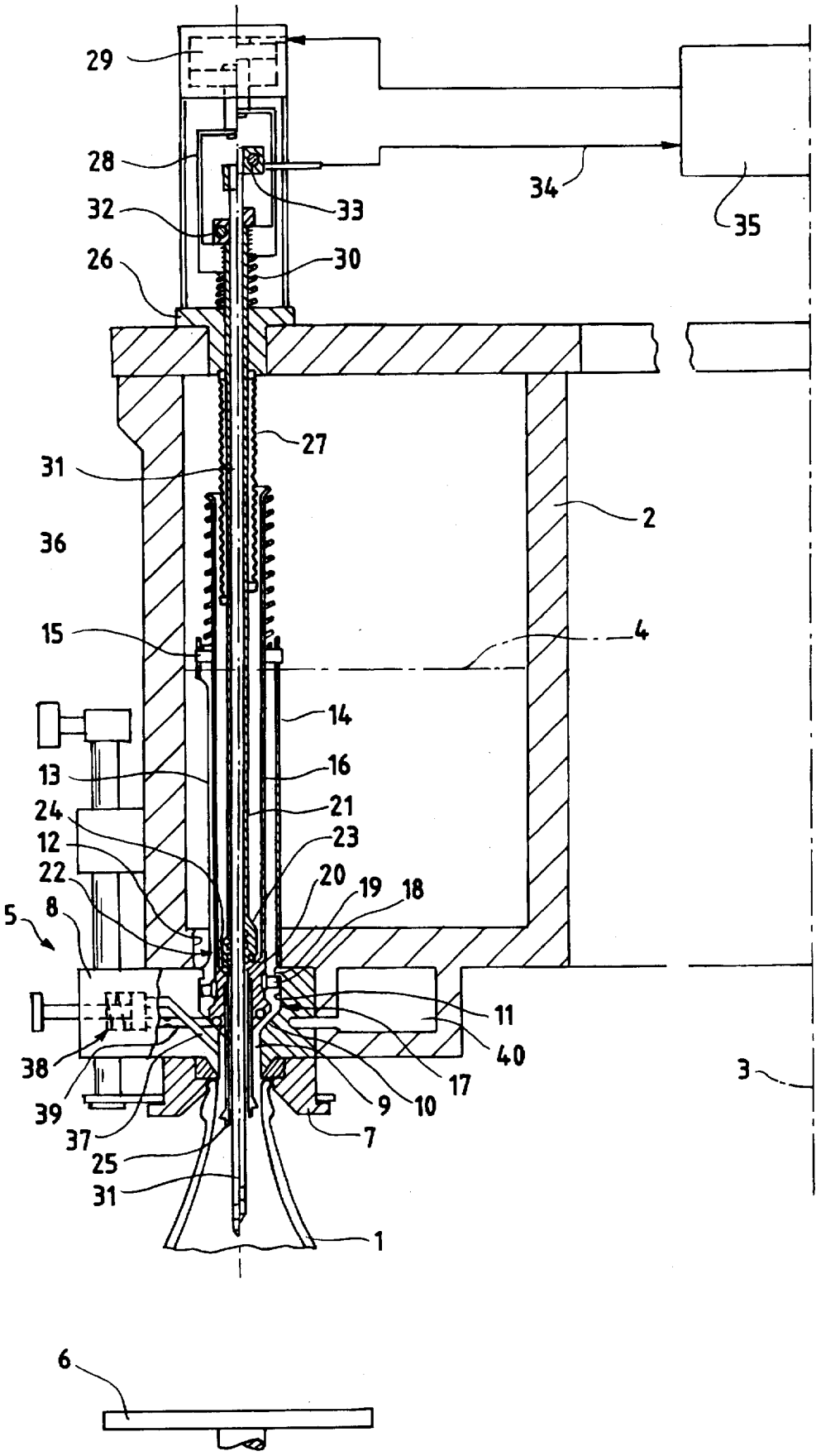
29
28
32
26
33
30
34
35
27
31
36
2
15
4
14
13
16
24
21
12
23
22
20
19
18
5
8
11
40
38
17
3
39
9
10
37
7
25
31
1
6

CONTAINER FILLING MACHINE

BACKGROUND OF THE INVENTION

FIELD OF THE INVENTION

The invention applies to a Container Filling Machine in accordance with the generic term in Claim 1.

There is already a well-known Container Filling Machine of this type, in which the tension gas valve is positioned in the storage tank above the liquid level indicator and whose valve body displays a pipe-like downwardly-directed elongation piece, which passes through the middle of the discharge mouth and then projects outward. The probe has a controllable fastener in the valve body or in its elongation, respectively, thereby forming a circular area which is open towards the bottom, and whose upper end is set-up with a throttled drainage-pipe that projects outwards into open space for the return gas, which will be pushed out during the filling of the container (DE-OS 2 007 896).

The filling device on this well-known Container Filling Machine displays a diversity of difficult-to-clean parts and of cavities filled with compressible gas padding, which causes disturbing hammer blows in the pipes during the filling process and especially during the discharging process. The manufacture of the filling device is costly and, due to the many structural pans which project out into the container, it can only fill those containers that have wide openings.

SUMMARY OF THE INVENTION

This invention's basic task is to noticeably improve on the type of Container Filling Machine mentioned above in the areas of precision filling, operative range, cleanability and construction costs.

This task will be accomplished, in accordance with this invention, by the indicated features, as noted in Claim 1.

The advantageous further-developments of the invention are contained in the subclaims.

DESCRIPTION OF THE PREFERRED EMBODIMENT

The following paragraphs describe a sample operation of the invention with reference to the diagram. The diagram portrays a vertical section of the Container Filling Machine in the area of the filling device whereby the liquid valve and the tension gas valve is depicted as closed on the left side and open on the right.

The depicted Container Filling Machine is set up to fill bottles with a carbonated drink, beer for example, at a hyperbaric counter-pressure. It depicts a ring-like closed storage tank 2 with a basically rectangular cross section, the former of which revolves around its vertical central axis 3. The storage tank 2 is filled up to the level indicator with the drink and above that, with the gas in the form of a high percentage CO2-air mixture and with an excess pressure of three bar. The delivery of the drink and of the tension gas occurs in the typical fashion through radial piping, rotating distributors and control units, etc., which are not shown.

A variety of identical filling devices 5 are uniformly distributed over the circumference of the storage tank 2, from which each is allocated a controllable lifting device 6 for the bottles 1 as well as a controllable centering bell 7 for the bottle opening.

Each filling device 5 displays a valve block 8 attached to the underside of the storage tank 2, where a vertical, cylindrical drainage opening 9 has been formed for the liquid. The drainage opening 9 passes upwards over a conical valve seat 10 into a wider vertical bore 11, which attaches itself from its end to a shaped vertical bore 12, contained in the base of the storage tank 2. A pipe tube 14, which has been equipped with several longitudinal slots 13, is fastened on the upper side of the valve block and is aligned with the bore 11 and projects through bore 12. A pipe tube 14 terminates above a level indicator 4 and is mounted with inwardly-directed guide pins 15 on the upper end, for a vertically standing, height-active controllable valve body 16.

The valve body 16 is conically tapered on the bottom end and outfitted with a conical nipple, which works with the valve seat 10. In this fashion, the valve body 16, together with the valve seat 10, makes up the liquid valve 17 of the filling device 5. If the valve body 16 is lowered, as depicted on the left side of the drawing, then no liquid can get out of the discharge mouth 9. If the valve body is raised, as is depicted on the right side of the drawing, the liquid can flow undiminished to a large extent and in a favorable stream through the slot 13 and the circular area between the pipe tube 14 and the valve body 16 as well as through the bores 12 and 11 and to the dispensing outlet 9 and through this into a bottle, which is pressed against the filling device 5 during the intermediate switching of the centralizing bell 7. In this process, the position of the opening is being defined by means of the contact between the lead pins 18, which are fastened on the valve body 16 and which loosely center the latter valve body in the bore 11, and a ring-like stopper 19 which is formed on the upper end of the bore 11 on the valve block 8.

The valve body 16 has a continuous bore which becomes conically narrower on the lower end directly above the liquid valve 17, while forming a wider valve seat 20. The valve seat 20 functions together with another vertical, height-controllable valve body 21 and forms the tension gas valve 22 of the filling device 5. The valve body 21 is basically pipe-like, whereby its outside diameter is significantly smaller than the inside diameter of the valve body 16, in whose bore it is concentrically arranged. At the lower end, the valve body 21 has a widening 23, which carries a conical nipple on the underside, and which functions together with the valve seat 20.

The widening 23 is supplied with several lead ribs 24 on the pipe casing, through which the valve body 21 is guided within the valve body 16 in an up- and downward motion. A return-gas pipe 25 connects to valve seat 20 toward the bottom end, and is detachably fastened in the lower end of the valve body 16 and, while forming a circular area for the liquid, projects concentrically through the discharge mouth in a freely downward fashion. The return gas pipe 25 is provided with a little cap on the lower end for the fluid during the filling process, protrudes across from the underside of the valve block 8 and, during the filling process, protrudes into the head area of one of the bottles 1, which are pressed against the filling device 8. On the one hand, it conducts the liquid which emerges from the discharge mouth 9 with its little cap, to the inner wall of the bottle 1 and additionally enables the inflow and outflow respectively, of the tension gas out of the storage tank 2 into and out of the bottle 1 respectively. If the valve body is lowered, as depicted on the left side of the drawing, then the passageway for tension gas is closed. If the valve body 21 is lifted, as depicted on the right side of the drawing, then a connection is created above the bore of the valve body 16 and the return gas pipe 25 between the tension gas area of the storage tank 2 above the level indicator 4 and that of the inner space of a bottle 1.

The valve body 21, compared to valve body 16, is elongated towards the top and is guided out of the storage tank 2 in a flexible manner through a lead sleeve 26 fastened in the cover of the storage tank 2. The gas- and liquid-proof passageway is blocked off by means of an elastic expansion bellows 27, which is fastened through a valve body 21 on the one hand and a lead sleeve 26 on the other. A bow 28 is fastened to the end of the valve body 21, and the bow projects upward out of the storage tank 2, and from its end is fastened to the piston rod of a simply operating pneumatic cylinder 29. The latter is bound rigidly with the lead sleeve 26. Moreover, a pressure spring 30, which surrounds valve body 21, is inserted between the bow 28 and the lead sleeve 26, and the pressure spring attempts to move the valve body 21 into its upper opened position.

The valve body 21 is permeated along its entire length by a rodlike probe 31, without the formation of a hollow space, whose outer diameter corresponds to the inner diameter of the valve body 21. During the interim connection of the washers, the probe 31 protrudes freely downward out of the widening 23 on the lower end of valve body 21 and while forming a circular area, stretches itself concentrically through the return-gas pipe 25, out of whose opening it protrudes freely. In this way, the probe 31 protrudes into the neck area, approximately up to the area of the desired filling level of one of the bottles 1, which is pressed against the filling device 5. The upper end of the probe 31 protrudes out of the valve body 21 and is fixed by means of a controllable clamp 32 located across from the valve body 21. In this way, the probe 31 participates to the full extent in the normal lifting motion of the gas valve's 22 valve body 21, which is caused by the pneumatic cylinder 29.

In addition, a measuring cable 34, which leads to electronic control equipment 35, is attached on the upper end of the probe 31 by means of an electric plug 33. In the example of the operation, this control equipment controls the pneumatic cylinder 29 exclusively and, thereby, also the liquid valve 17 and the tension gas valve 22 in combination with the pressure springs 36, which are inserted in the guide bolts 15 on the one hand and the bent-down upper end of the valve body 16 on the other.

If the pneumatic cylinder 29 is impinged on with compressed air, then the valve body 21 will be pressed directly downwards against the valve seat above the bows 28 and against the strength of the pressure springs; as a consequence the tension gas valve 22 is closed. At the same time, the valve body 16 will also be indirectly pressed over the widening 23 and the valve seat 20 against the strength of the pressure springs 36 and downward against the valve seat 10. Consequently, the liquid valve 17 is also closed. The filling device 5 returns this condition at the end of a filling process, or between 2 filling processes respectively.

If the compressed air cylinder is evacuated of air, then the bow 28 and thereby the valve body 21 is pushed into its upper final position by the strength of the pressure springs; the tension gas valve 22 is opened as a consequence. The liquid valve 17 still remains closed for the time being due to the effect of the excess pressure in the storage tank 2. Not until the pressure is evened out by the tension gas which is flowing into the bottle 1 above the tension gas valve 22 and the return gas pipe 25, will the valve body 16 also be lifted by the compressed springs 36; as a consequence the liquid valve 17 is opened. The liquid can then flow into the bottle 1 over the liquid valve 17 and the outflow opening 9. As soon as the level of the liquid reaches the bottom calibration area or the end calibration area, respectively of the probe 31, which for example is developed as conductivity probe or short-circuit probe, this probe sends a signal to the control equipment 35 over the instrument leads 34. This releases, either immediately or after an adjustable recovery time, the air inflow to the pneumatic cylinder 29, whereby the liquid valve 17 and the tension gas valve 22 are closed together. The bottle 1 is filled exactly up to the desired level indicator.

In order to enable a specific discharging of the bottle 1, which is pressed against the filling device 5, and after the actual, completed filling process in the manner described above, a release canal 37 is formed discharging diagonally downwards into the discharge opening 9 in the valve block 8. This release canal leads to a mechanically-controllable release valve 38, above which it can be joined with a canal 39 and further with a developed closed circular pipeline 40, which has been formed on the underside of the storage tank 2. Atmospheric pressure prevails in this pipeline, so that by means of a cam-controlled, momentary opening of the release valve 38, a specific pressure build-up in the bottle 1 can be accomplished before the removal from the filling device, especially when a choke is placed in the canal 39. During the cleaning of the Container Filling Machine, the closed circuit pipeline serves to pass back the cleaning liquid, which is delivered through the storage bin 2 in the closed cycle. In a similar fashion, further canals and control valves, which junction into the discharge mouth 9, can be arranged, for example for a vacuum.

I claim:

1. Container Filling Machine comprising in combination: a storage tank for liquid that is to be used for filling and for tension gas, at least one filling device containing no filling pipe is attached in said storage tank, said at least one filling device having a discharge mouth for the liquid; a liquid valve serially-connected to said discharge mouth; a tension gas valve positioned into a spring-weighted, height-adjustable valve body; a gas-proof probe for determining fill-height is contained in said height-adjustable valve body and able to be inserted into a container; and a probe-controllable control unit for said valve body of said tension gas valve, whereby said probe takes part in the lifting motion of said valve body of said tension gas valve and protrudes downward across said discharge mouth, and said gas-proof probe (31) is guided out of the bottom end of said valve body (21) of said tension gas valve (22).

2. Container Filling Machine, according to claim 1, wherein said discharge mouth (9) is connected to a controllable valve (38) by means of a canal 37.

3. Container Filling Machine, according to claim 2, wherein said controllable valve (38) is connected to a closed circular pipeline (40).

4. Container Filling Machine, according to claim 1, wherein said tension gas valve (22), as maintained below a level indicator (4) in said storage tank (2), is placed directly above said liquid valve (17).

5. Container Filling Machine, according to claim 4, wherein said valve body (21) of said tension gas valve (22) terminates at the height of said valve seat (20), and said probe (31) projects freely out of said valve body (21) and through said valve body (16) of said liquid valve (17) and of said discharge mouth (9).

6. Container Filling Machine, according to claim 5, wherein a gas pipe (25) is fastened to said bottom end of said valve body (16) of said liquid valve (17), and said gas pipe encircles, at least in part immediately during the formation of a circular area, the region of said probe (31) which projects out of said valve body (21).

7. Container Filling Machine, according to claim 6, wherein said valve seat (10) of said liquid valve (17) and said canal (37), if necessary, are formed into a valve block (8), which is fastened to the underside of said storage tank (2) and which is connected to its interior space by means of a bore (12) in the foundation of said storage tank.

8. Container Filling Machine, according to claim 7, wherein said valve body (16) of said tension gas valve (22) and/or said probe (31) is guided flexibly through the cover of the storage bin (2) into the open air and is connected to said control unit which is positioned on said cover.

9. Container Filling Machine, according to claim 8, wherein a pipe (14) equipped with side openings (13) is fastened to the upper part of said valve block (9), and said valve body (16) of said liquid valve (17) is operated with vertical adjustment in said pipe (14).

10. Container Filling Machine, according to claim 9, wherein a pressure spring (36) is propped against the upper end of said pipe (14), and the top end of said pressure spring props itself up against the upper end of said valve body (16), and said valve body (16) projects out of said pipe (14) and ends within said storage bin (2) over said probe (4).

* * * * *